US009491537B2

(12) United States Patent
Christoph

(10) Patent No.: US 9,491,537 B2
(45) **Date of Patent: *Nov. 8, 2016**

(54) NOISE REDUCING SOUND REPRODUCTION SYSTEM

(75) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 587 days.

This patent is subject to a terminal disclaimer.

(21) Appl. No.: 13/559,093

(22) Filed: Jul. 26, 2012

(65) Prior Publication Data

US 2013/0028436 A1 Jan. 31, 2013

(30) Foreign Application Priority Data

Jul. 26, 2011 (EP) ..... 11175344

(51) Int. Cl.
*H04R 3/02* (2006.01)
*H04R 3/00* (2006.01)

(52) U.S. Cl.
CPC ..... *H04R 3/00* (2013.01)

(58) Field of Classification Search
CPC .. H04R 27/00; H04R 1/1041; G10K 11/175; H04K 1/02
USPC ..... 379/406; 381/94
See application file for complete search history.

(56) References Cited

U.S. PATENT DOCUMENTS

| | | | | |
|---|---|---|---|---|
| 5,361,381 | A * | 11/1994 | Short | 381/80 |
| 7,451,079 | B2 * | 11/2008 | Oudeyer | 704/205 |
| 8,223,986 | B2 * | 7/2012 | Sander et al. | 381/74 |
| 8,515,089 | B2 * | 8/2013 | Nicholson | 381/71.6 |
| 2004/0252846 | A1 | 12/2004 | Nonaka et al. | 381/71.4 |
| 2009/0220101 | A1 | 9/2009 | Bachmann | 381/71.4 |
| 2010/0329473 | A1 | 12/2010 | Rauhala | 381/71.1 |

FOREIGN PATENT DOCUMENTS

| | | | | |
|---|---|---|---|---|
| EP | 1 947 642 | A1 | 7/2008 | G10K 11/178 |
| JP | H03274895 | A | 12/1991 | |
| JP | 6 308976 | | 4/1993 | G10K 11/16 |
| JP | 6 308976 | | 11/1993 | G10K 11/16 |
| JP | 2007500466 | A | 1/2007 | |
| JP | 2009 045955 | | 3/2009 | G10K 11/178 |
| WO | 2009041012 | A1 | 4/2009 | |

OTHER PUBLICATIONS

U.S. Appl. No. 13/557,869, filed Jul. 25, 2012.
European Search Report, dated Mar. 2, 2012, European Patent Application No. 11 175 344.8-1224, European Patent Office, Germany, 7 pgs.

(Continued)

*Primary Examiner* — Simon Sing
(74) *Attorney, Agent, or Firm* — Alleman Hall McCoy Russell & Tuttle LLP

(57) ABSTRACT

A noise reducing sound reproduction system and method may be operable with an input signal supplied to a loudspeaker by which it is acoustically radiated. The signal radiated by the loudspeaker may be received by a microphone that is acoustically coupled to the loudspeaker via a secondary path and that provides a microphone output signal. From the microphone output signal a useful-signal can be subtracted to generate a filter input signal. The filter input signal is filtered in an active noise reduction filter to generate an error signal, and the useful-signal is subtracted from the error signal to generate the loudspeaker input signal. In addition, the useful-signal is filtered by one or more spectrum shaping filters prior to subtraction from the microphone output signal or the loudspeaker input signal or both.

20 Claims, 4 Drawing Sheets

(56) References Cited

OTHER PUBLICATIONS

Woon S. Gan et al., "An Integrated Audio and Active Noise Control Headsets," IEEE Transactions on Consumer Electronics, vol. 48, No. 2, May 2002, 6 pgs.

Sen M. Kuo et al., "Active Noise Control: A Tutorial Review," Proceedings of the IEEE, vol. 87, No. 6, Jun. 1999, 32 pgs.

Colin H., Hansen et al., "Active Control of Noise and Vibration," E&FN Spon, Foundary Row, London, 1997, 20 pgs.

Japanese Patent Office, Office Action Issued in Japanese Patent Application No. 2012-136857, May 2, 2016, 11 pages.

* cited by examiner

NOISE REDUCING SOUND REPRODUCTION SYSTEM

PRIORITY CLAIM

This application claims the benefit of priority from European Patent Application No. 11 175 344.8-1224, filed Jul. 26, 2011, which is incorporated here by reference.

BACKGROUND OF THE INVENTION

1. Field

This invention relates to a noise reducing sound reproduction system and, in particular, a noise reduction system which includes an earphone for allowing a user to enjoy, for example, reproduced music or the like, with reduced ambient noise.

2. Related Art

In active noise reduction systems, also known as active noise cancellation/control (ANC) systems, the same loudspeakers, in particular loudspeakers arranged in the two earphones of headphones, are often used for both noise reduction and reproduction of desirable sound such as music or speech. However, there is a significant difference between the sound impression created by employing active noise reduction and the impression created by not employing active noise reduction, due to the fact that noise reduction systems reduce the desirable sound to a certain degree, as well as the noise. Accordingly, the listener has to accept sound impressions that differ, depending on whether noise reduction is on or off. Therefore, there is a general need for an improved noise reduction system to overcome this drawback.

SUMMARY OF THE INVENTION

In a first aspect, a noise reducing sound reproduction system may include: a loudspeaker that is connected to a loudspeaker input path, and a microphone that is acoustically coupled to the loudspeaker via a secondary path. The microphone may also be connected to a microphone output path. The noise reproducing sound system may also include a first subtractor that is connected downstream of the microphone output path and also connected to a first useful-signal path, an active noise reduction filter that is connected downstream of the first subtractor, and a second subtractor that is connected between the active noise reduction filter and the loudspeaker input path and also to a second useful-signal path. Both useful-signal paths may be supplied with a useful signal to be reproduced, and at least one of the useful-signal paths comprise one or more spectrum shaping filters.

In a second aspect, a noise reducing sound reproduction method is disclosed in which, an input signal is supplied to a loudspeaker by which it is acoustically radiated. The signal radiated by the loudspeaker is received by a microphone that is acoustically coupled to the loudspeaker via a secondary path and that provides a microphone output signal. From the microphone output signal a useful-signal may be subtracted to generate a filter input signal. The filter input signal may be filtered in an active noise reduction filter to generate an error signal. The useful-signal may be subtracted from the error signal to generate the loudspeaker input signal. The useful-signal may be filtered by one or more spectrum shaping filters prior to subtraction from the microphone output signal or the loudspeaker input signal or both.

BRIEF DESCRIPTION OF THE DRAWINGS

Various specific embodiments are described in more detail below based on the exemplary embodiments shown in the figures of the drawing. Unless stated otherwise, similar or identical components are labeled in all of the figures with the same reference numbers.

DETAILED DESCRIPTION

Figure 1:
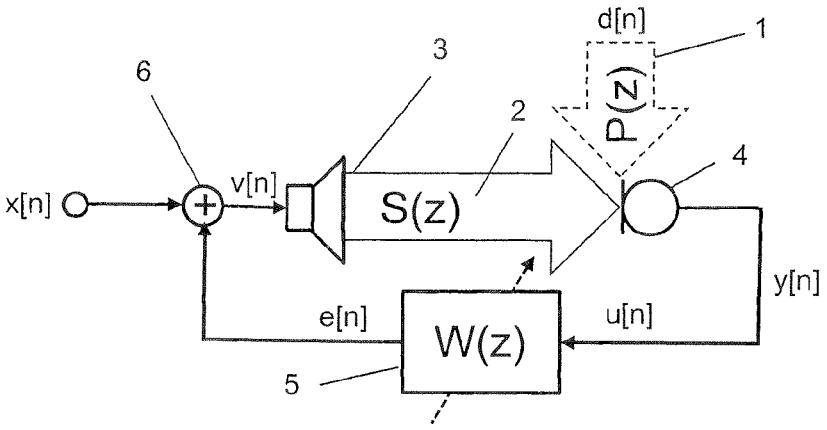
FIG. 1 is a block diagram of an example feedback type active noise reduction system in which the useful signal is supplied to the loudspeaker signal path.

Feedback ANC systems can reduce or even cancel a disturbing signal, such as a noise signal, by providing at a listening site, or in a listening space, a noise reducing signal that ideally has the same amplitude over time but the opposite phase compared to the noise signal. By superimposing the noise signal and the noise reducing signal the resulting signal, also known as error signal, ideally tends toward zero decibels (dB), or at least to the point where it is not discernible by a human listener. The quality of the noise reduction depends on the quality of a secondary path, such as the acoustic path between a loudspeaker and a microphone, which can represent the listener's ear. The quality of the noise reduction further depends on the quality of a ANC filter that is connected between the microphone and the loudspeaker. The ANC filter may filter the error signal provided by the microphone such that, when the filtered error signal is reproduced by the loudspeaker, it further reduces the error signal. However, problems can occur such as when in addition to the filtered error signal, a useful signal such as music or speech is provided at the listening site. The useful signal may, for example, be provided by the loudspeaker that also reproduces the filtered error signal. In this situation, the useful signal may be deteriorated by the system, as previously mentioned.

For the sake of simplicity, no distinction is made herein between electrical and acoustic signals. However, all signals provided by the loudspeaker or received by the microphone are actually audible sound of an acoustic nature. All other signals are electrical in nature. The loudspeaker and the microphone may be part of an acoustic sub-system (e.g., a loudspeaker-room-microphone system) having an input stage formed by a loudspeaker and an output stage formed by a microphone. The sub-system may be supplied with an electrical input signal and providing an electrical output signal. As used herein, the term "Path" means an electrical or acoustical connection that may include further elements such as signal conducting means, amplifiers, filters, and any other signal conveyance. As used herein, the terms "spectrum shaping filter" is a filter in which the spectra of the input and output signal are different over a predetermined range of frequency.

As described herein, the components of the example feedback type active noise reduction systems may be electrical circuits operable in the analog domain and in communication to process signals, digital devices operable in the digital domain and in communication to process signals, or a combination of cooperatively operating analog and digital devices. Analog devices may include hardware such as various resistors, capacitors, inductors, diodes, transistors, and other electrical circuit components, including but not limited to logic circuits, gates, circuit boards, and the like. Digital devices may include a processor, such as a microprocessor, a digital signal processor, a field programmable gate array, and/or any other computing or logic device or system capable of executing instructions. Digital devices may also include one or more memory devices configured to store instructions and data. The instructions are executable by the processor to provide the functionality of the system and/or to direct, and/or control for performance analog and/or digital devices included in the system. The memory may include, but is not limited to any form of non-transitory computer readable storage media such as various types of volatile and non-volatile storage media, including but not limited to random access memory, read-only memory, programmable read-only memory, electrically programmable read-only memory, electrically erasable read-only memory, flash memory, magnetic tape or disk, optical media and the like.

Reference is now made to FIG. 1, which is a block diagram illustrating an example feedback type active noise reduction (ANC) system in which a disturbing signal d[n], also referred to as noise signal, is transferred (radiated) to a listening site, such as a listener's ear, via a primary path 1. The primary path 1 has a transfer characteristic of P(z). Additionally, an input signal v[n] is acoustically transferred (radiated) from a loudspeaker 3 to the listening site via a secondary path 2. The secondary path 2 has a transfer characteristic of S(z). A microphone 4 positioned at the listening site receives together with the disturbing signal d[n] the signals that arise from the loudspeaker 3. The microphone 4 provides a microphone output signal y[n] that represents the sum of these received signals. The microphone output signal y[n] is supplied as filter input signal u[n] to an ANC filter 5 that outputs to an adder 6 an error signal e[n]. The ANC filter 5 which may be an adaptive filter has a transfer characteristic of W(z). The adder 6 also receives an optionally pre-filtered, such as with a spectrum shaping filter (not shown in the drawings) useful signal x[n] such as music or speech and provides an input signal v[n] to the loudspeaker 3.

The signals x[n], y[n], e[n], u[n] and v[n] can be provided in the discrete time domain, for example. In other examples, one or more of the signals x[n], y[n], e[n], u[n] and v[n] may be in the frequency domain. For the following considerations their spectral representations X(z), Y(z), E(z), U(z) and V(z) are used. The differential equations describing the system illustrated in FIG. 1 are as follows:

$$Y(z)=S(z)\cdot V(z)=S(z)\cdot(E(z)+X(z)) \tag{1}$$

$$E(z)=W(z)\cdot U(z)=W(z)\cdot Y(z) \tag{2}$$

In the system of FIG. 1, the useful signal transfer characteristic M(z)=Y(z)/X(z) is thus $$M(z)=S(z)/(1-W(z)\cdot S(z)) \tag{3}$$

Assuming W(z)=1 then $$\lim[S(z)\rightarrow 1]M(z)\Rightarrow M(z)\rightarrow\infty \tag{4}$$

$$\lim[S(z)\rightarrow\pm\infty]M(z)\Rightarrow M(z)\rightarrow 1 \tag{5}$$

$$\lim[S(z)\rightarrow 0]M(z)\Rightarrow S(z) \tag{6}$$

Assuming W(z)=∞ then $$\lim[S(z)\rightarrow 1]M(z)\Rightarrow M(z)\rightarrow 0. \tag{7}$$

As can be seen from equations (4)-(7), the useful signal transfer characteristic M(z) approaches 0 when the transfer characteristic W(z) of the ANC filter 5 increases, while the secondary path transfer function S(z) remains neutral, such as at levels around about 1 or 0 [dB]. For this reason, the useful signal x[n] can be adapted accordingly to ensure that the useful signal x[n] is comprehended substantially identically by a listener when ANC processing is on or off. Furthermore, the useful signal transfer characteristic M(z) can also depend on the transfer characteristic S(z) of the secondary path 2 to the effect that the adaption of the useful signal x[n] also depends on the transfer characteristic S(z) and its fluctuations due to aging, temperature, change of listener etc. so that a certain difference between "on" and "off" of the ANC system could be apparent.

Figure 2:
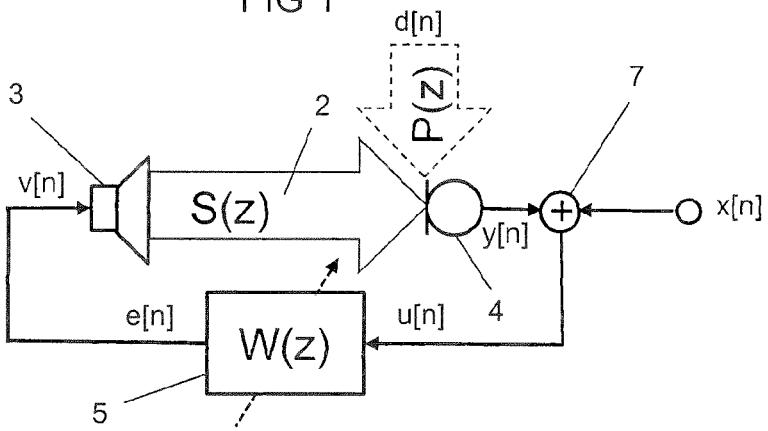
FIG. 2 is a block diagram of an example feedback type active noise reduction system in which the useful signal is supplied to the microphone signal path.

While in the system of FIG. 1 the useful signal x[n] is supplied to the acoustic sub-system (loudspeaker, room, microphone) at the adder 6, connected upstream of the loudspeaker 3, in the system of FIG. 2 the useful signal x[n] is supplied at the microphone 4. Therefore, in the system of FIG. 2, the adder 6 is omitted and an adder 7 is arranged downstream of microphone 4 to sum up the useful signal x[n] and the microphone output signal y[n]. The signal x[n] may be pre-filtered, as previously discussed. Accordingly, the loudspeaker input signal v[n] is the error signal [e], such that v[n]=[e], and the filter input signal u[n] is the sum of the useful signal x[n] and the microphone output signal y[n], i.e., u[n]=x[n]+y[n].

The differential equations describing the system illustrated in FIG. 2 are as follows:

$$Y(z)=S(z)\cdot V(z)=S(z)\cdot E(z) \tag{8}$$

$$E(z)=W(z)\cdot U(z)=W(z)\cdot(X(z)+Y(z)) \tag{9}$$

The useful signal transfer characteristic M(z) in the system of FIG. 2 without considering the disturbing signal d[n] is thus $$M(z)=(W(z)\cdot S(z))/(1-W(z)\cdot S(z)) \tag{10}$$

$$\lim[(W(z)\cdot S(z))\rightarrow 1]M(z)\Rightarrow M(z)\rightarrow\infty \tag{11}$$

$$\lim[(W(z)\cdot S(z))\rightarrow 0]M(z)\Rightarrow M(z)\rightarrow 0 \tag{12}$$

$$\lim[(W(z)\cdot S(z))\rightarrow\pm\infty]M(z)\Rightarrow M(z)\rightarrow 1. \tag{13}$$

As can be seen from equations (11)-(13), the useful signal transfer characteristic M(z) approaches 1 when the open loop transfer characteristic (W(z)·S(z)) increases or decreases and approaches 0 when the open loop transfer characteristic (W(z)·S(z)) approaches zero. For this reason, the useful signal x[n] can be adapted additionally in higher spectral ranges to ensure that the useful signal x[n] is comprehended substantially identically by a listener when ANC is on or off Compensation in higher spectral ranges can be quite difficult so that a certain difference between "on" and "off" may be apparent. On the other hand, the useful signal transfer characteristic M(z) does not depend on the transfer characteristic S(z) of the secondary path 2 and its fluctuations due to aging, temperature, change of listener and other parameters affecting the transfer characteristic S(z).

Figure 3:
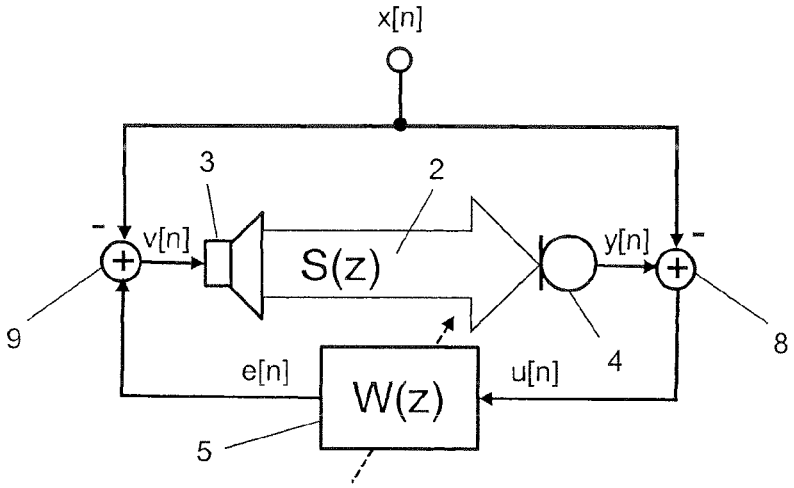
FIG. 3 is a block diagram of an example feedback type active noise reduction system in which the useful signal is supplied to the loudspeaker and microphone signal paths.

FIG. 3 is a block diagram illustrating an example feedback type active noise reduction system in which the useful signal is supplied to both, the loudspeaker path and the microphone path. For the sake of simplicity, the primary path 1 is omitted from FIG. 3, notwithstanding that noise (disturbing signal d[n]) is still present. In particular, the system of FIG. 3 is based on the system of FIG. 1, however, with an additional subtractor 8 that subtracts the useful signal x[n] from the microphone output signal y[n] to form the ANC filter input signal u[n] and with a subtractor 9 that substitutes adder 6 (FIG. 1) and subtracts the useful signal x[n] from error signal e[n] to generate a loudspeaker input signal v[n].

The differential equations describing the system illustrated in FIG. 3 are as follows:

$$Y(z)=S(z)\cdot V(z)=S(z)\cdot(E(z)-X(z)) \tag{14}$$

$$E(z)=W(z)\cdot U(z)=W(z)\cdot(Y(z)-X(z)) \tag{15}$$

The useful signal transfer characteristic M(z) in the system of FIG. 3 is thus $$M(z)=(S(z)-W(z)\cdot S(z))/(1-W(z)\cdot S(z)) \tag{16}$$

$$\lim[(W(z)\cdot S(z))\rightarrow 1]M(z)\Rightarrow M(z)\rightarrow\infty \tag{17}$$

$$\lim[(W(z)\cdot S(z))\rightarrow 0]M(z)\Rightarrow M(z)\rightarrow S(z) \tag{18}$$

$$\lim[(W(z)\cdot S(z))\rightarrow\pm\infty]M(z)\Rightarrow M(z)\rightarrow 1. \tag{19}$$

It can be seen from equations (17)-(19) that the behavior of the system of FIG. 3 is similar to that of the system of FIG. 2. One difference is that the useful signal transfer characteristic M(z) approaches S(z) when the open loop transfer characteristic (W(z)·S(z)) approaches 0. Like the system of FIG. 1, the system of FIG. 3 depends on the transfer characteristic S(z) of the secondary path 2 and its fluctuations due to aging, temperature, change of listener, and other parameters affecting the transfer characteristic S(z).

Figure 4:
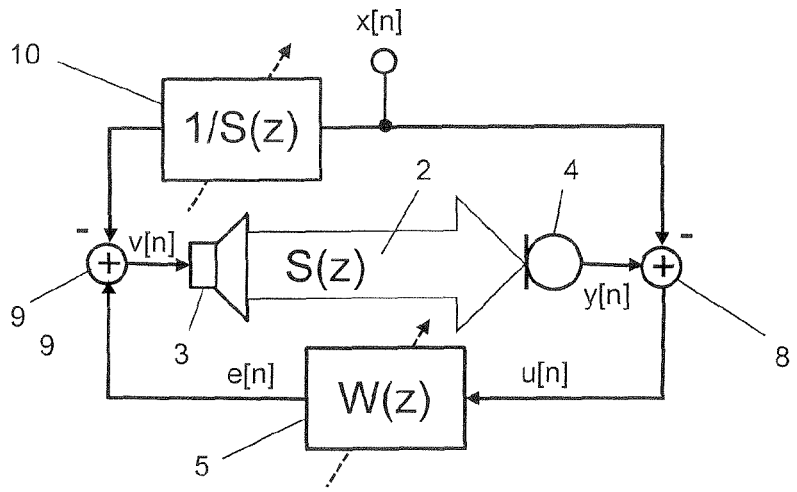
FIG. 4 is a block diagram of an example of the active noise reduction system of FIG. 3, in which the useful signal is supplied via a spectrum shaping filter to the loudspeaker path.

In FIG. 4, an example system is shown that is based on the system of FIG. 3 and that additionally includes an equalizing filter 10 connected upstream of the subtractor 9 in order to filter the useful signal x[n] with the inverse secondary path transfer function 1/S(z). The differential equations describing the system illustrated in FIG. 4 are as follows:

$$Y(z)=S(z)\cdot V(z)=S(z)\cdot(E(z)-X(z)/S(z)) \tag{20}$$

$$E(z)=W(z)\cdot U(z)=W(z)\cdot(Y(z)-X(z)) \tag{21}$$

The useful signal transfer characteristic M(z) in the system of FIG. 4 is thus $$M(z)=(1-W(z)\cdot S(z))/(1-W(z)\cdot S(z))=1 \tag{22}$$

As can be seen from equation (22), the microphone output signal y[n] is substantially identical to the useful signal x[n], which means that signal x[n] is not altered by the system if the equalizer filter 10 is the inverse of the secondary path transfer characteristic S(z). The equalizer filter 10 may be a minimum-phase filter for optimum results, i.e., optimum approximation of its actual transfer characteristic to the inverse of, the ideally minimum phase, secondary path transfer characteristic S(z) and, thus y[n]=x[n]. This configuration acts as an ideal linearizer, such that it compensates for any deteriorations of the useful signal due to transfer of the useful signal as audible sound from the loudspeaker 3 to the microphone 4 representing the listener's ear. The configuration compensates for, or linearizes the disturbing influence of the secondary path S(z) on the useful signal x[n], such that the useful signal x[n] arrives at the listener as provided by the source, without any perceived negative effect due to acoustical properties of the headphone, since y[z]=x[z]. As such, with the help of such a linearizing filter it is possible to make a poorly designed headphone sound like an acoustically perfectly adjusted, i.e. linear one.

Figure 5:
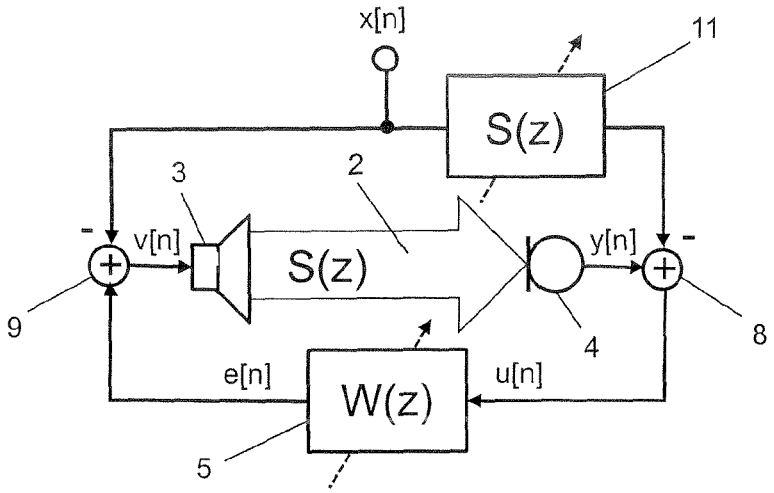
FIG. 5 is a block diagram of another example of the active noise reduction system of FIG. 3, in which the useful signal is supplied via a spectrum shaping filter to the microphone path.

In FIG. 5, an example system is shown that is based on the system of FIG. 3 and that additionally includes an equalizing filter 11 connected upstream of the subtractor 8 in order to filter the useful signal x[n] with the secondary path transfer function S(z).

The differential equations describing the system illustrated in FIG. 5 can be as follows:

$$Y(z)=S(z)\cdot V(z)=S(z)\cdot(E(z)-X(z)) \tag{23}$$

$$E(z)=W(z)\cdot U(z)=W(z)\cdot(Y(z)-S(z)\cdot X(z)) \tag{24}$$

The useful signal transfer characteristic M(z) in the system of FIG. 5 is thus $$M(z)=S(z)\cdot(1+W(z)\cdot S(z))/(1+W(z)\cdot S(z))=S(z) \tag{25}$$

From equation (25) it can be seen that the useful signal transfer characteristic M(z) is substantially identical with the secondary path transfer characteristic S(Z) when the ANC system is active. When the ANC system is not active, the useful signal transfer characteristic M(z) is also identical with the secondary path transfer characteristic S(Z). Thus, the aural impression of the useful signal for a listener at a location close to the microphone 4 is the same regardless of whether noise reduction is active or not.

The ANC filter 5 and the equalizing filters 10 and 11 may be fixed filters with constant transfer characteristics or adaptive filters with controllable transfer characteristics. In the drawings, the adaptive structure of a filter is indicated by an arrow underlying the respective block and the optionality of the adaptive structure is indicated by the arrow being a broken line.

The system shown in FIG. 5 is, for example, applicable in headphones in which useful signals, such as music or speech, are reproduced under different conditions in terms of noise and the listener may appreciate being able to switch off the ANC system, in particular when no noise is present, without experiencing any audible difference between the active and non-active state of the ANC system. However, the systems presented herein are not applicable in headphones only, but also in all other fields in which occasional noise reduction is desired.

Figure 6:
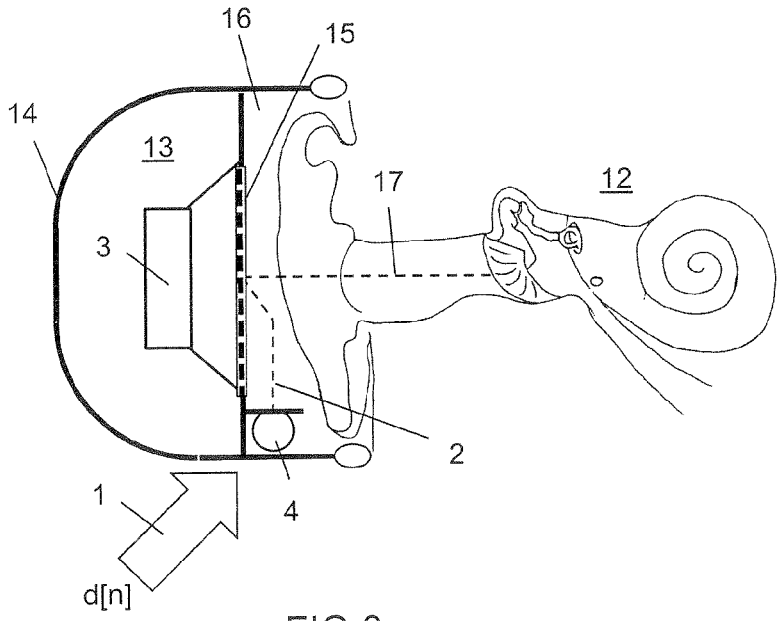
FIG. 6 is a schematic diagram of an example earphone that can be used in connection with the active noise reduction systems of FIGS. 3-5.

FIG. 6 illustrates an exemplary earphone with which the present active noise reduction systems may be used. The earphone may be, together with another similar earphone, part of a headphone (not shown) and may be acoustically coupled to a listener's ear 12. In the present example, the ear 12 is exposed via primary path 1 to the disturbing signal d[n], such as ambient noise. The earphone comprises a cup-like housing 14 with an aperture 15 that may be covered by a sound permeable cover, such as a grill, a grid or any other sound permeable structure or material. The loudspeaker 3 radiates sound to the ear 12 and is arranged at the aperture 15 of the housing 14, and is positioned within an earphone cavity 13 formed by the housing 14. The cavity 13 may be airtight or vented by any means, e.g., by means of a port, vent, opening, or other mechanisms allowing a flow of air between the cavity 13 and external to the housing 14. The microphone 4 is positioned in front of the loudspeaker 3. An acoustic path 17 extends from the speaker 3 to a listening position, such as the ear 12 and has a transfer characteristic which is approximated for noise control purposes by the transfer characteristic of the secondary path 2 which extends from the loudspeaker 3 to the microphone 4.

In mobile devices such as headphones, the space and energy available for the ANC system is quite limited. Digital circuitry may be too space and energy consuming and in mobile devices analog circuitry can be preferred in the design of ANC systems. However, analog circuitry only allows for a limited complexity of the ANC system and thus correctly modeling the secondary path solely by analog means can be difficult. In particular, analog filters used in an ANC system are often fixed filters or very simple adaptive filters because they are easy to build, have low energy consumption and require little space. The systems illustrated above with reference to FIGS. 4, 5 and 7 can provide good results when employing analog circuitry since there is a minor (FIG. 4) or even no (FIGS. 5 and 7) dependency on the secondary path behavior. Furthermore, the systems of FIGS. 5 and 7 allow for a good estimation of the transfer characteristic of the equalization filter based on the ANC filter transfer characteristic W(z), as well as on the secondary path filter characteristic S(z). The ANC filter transfer characteristic W(z) and the secondary path filter characteristic S(z) form the open loop transfer characteristic W(z)·S(z), which, in principal, has only minor fluctuations, and can be based on the assessment of the acoustic properties of the headphone when attached to a listener's head.

The ANC filter 5 can have a transfer characteristic that tends to have lower gain at lower frequencies with an increasing gain over frequency to a maximum gain followed by a decrease of gain over frequency down to loop gain. With high gain of the ANC filter 5, the loop inherent in the ANC system can keep the system linear in a predetermined frequency range such as, below 1 kHz and thus can render any equalization redundant in the predetermined frequency range. In the frequency range above 3 kHz, the ANC filter 5 can be configured to provide almost no boosting or cutting effects and, accordingly, no linearization effects. Since the ANC filter gain in this frequency range can be approximately loop gain, the useful signal transfer characteristic M(z) experiences a boost at higher frequencies that has to be compensated for by means of a respective filter, such as a shelving filter. The shelving filter may be in addition to an equalizing filter. In the frequency range between 1 kHz and 3 kHz both, boosts and cuts in the signal being filtered, may occur. In terms of aural impression of a listener, boosts can be more disturbing than cuts and thus it may be sufficient to compensate for boosts in the transfer characteristic by correspondingly designed cut filters. If the ANC filter gain is 0 dB above 3 kHz, there is no linearization effect and, therefore, in addition to a first equalization filter and instead of a shelving filter, a second equalization filter may be used.

Figure 7:
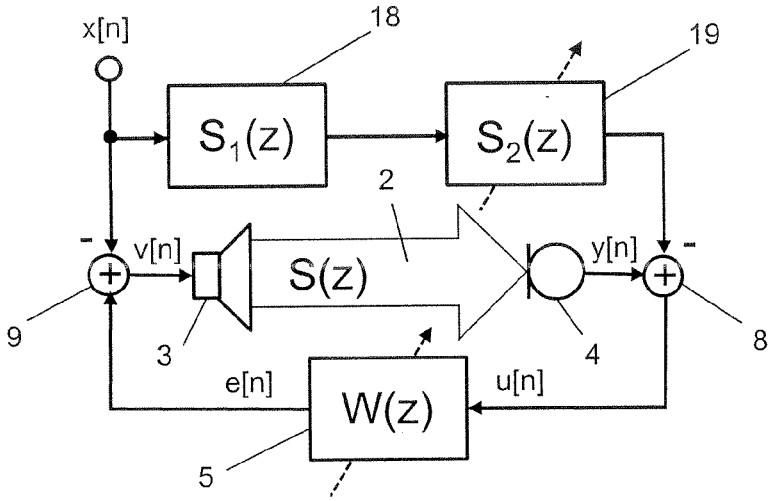
FIG. 7 is a block diagram of an example of an active noise reduction system in which the useful signal is supplied via two spectrum shaping filters to the microphone path.

As can be seen from the above considerations, at least two filters may be used for compensation of the useful signal x[n]. FIG. 7 shows an exemplary ANC system that employs (at least) two filters 18 and 19 (sub-filters) instead of a single filter 11 as in the system of FIG. 5. For instance, a treble cut shelving filter (filter 18) having a transfer characteristic $S_1(z)$ and a treble cut equalizing filter (filter 19) having a transfer characteristic $S_2(z)$, in which $S(z)=S_1(z)\cdot S_2(z)$. Alternatively, a treble boost equalizing filter may be implemented as, filter 18 and a treble cut equalizing filter as filter 19. In FIG. 7, the second filter 21 may be implemented as an adaptive filter. If the useful signal transfer characteristic M(z) exhibits an even more complex structure, three filters may be employed, such as one treble cut shelving filter and two treble boost/cut equalizing filters. The number of filters used may depend on many other aspects such as costs, noise behavior of the filters, acoustic properties of the headphone, delay time of the system, physical space available for implementing the system, and/or any other parameter effecting operation of the ANC system.

Figure 8:
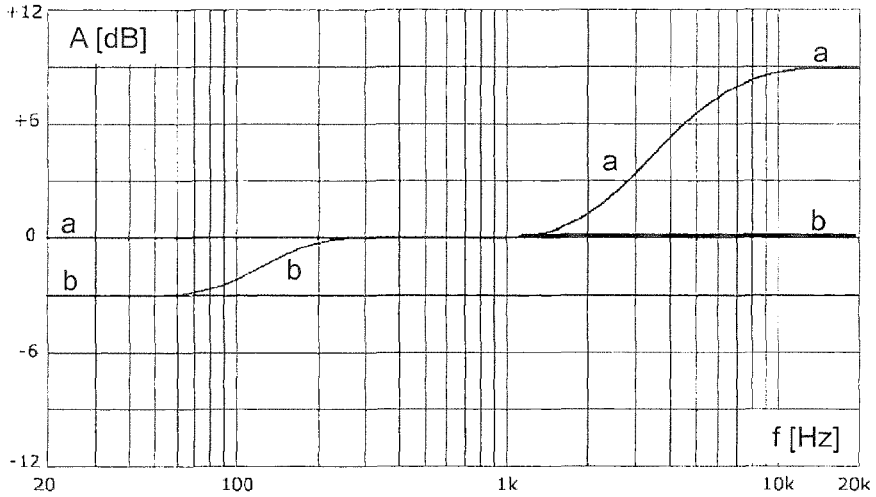
FIG. 8 is a magnitude frequency response diagram representing an example of the transfer characteristics of shelving filters that may be used in the system of FIG. 7.
Figure 9:
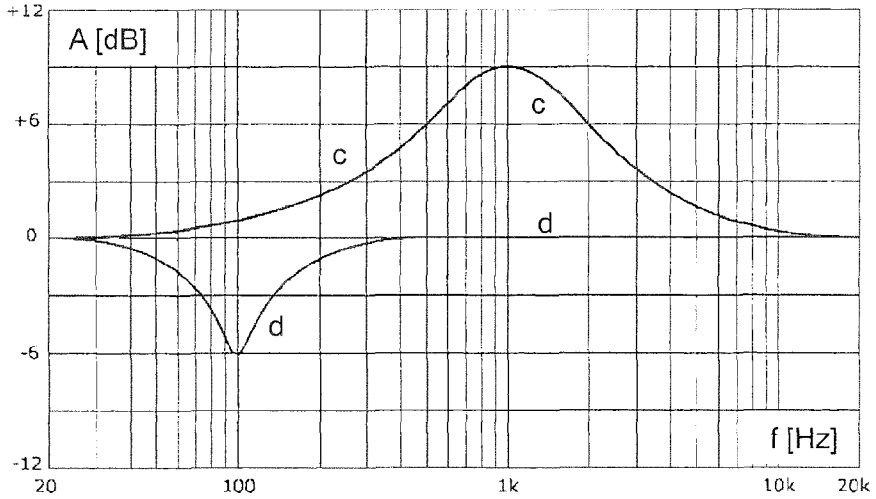
FIG. 9 is a magnitude frequency response diagram representing an example of transfer characteristics of equalizing filters that may be used in the system of FIG. 7.

FIG. 8 is a schematic diagram of an example of the transfer characteristics a, b of shelving filters applicable in the system of FIG. 7. In particular, a first order treble boost (+9 dB) shelving filter (identified as "a") and a bass cut (−3 dB) shelving filter (identified as "b") are shown. FIG. 9 is a schematic diagram of the transfer characteristics c, d of example equalizing filters that may be applicable in the system of FIG. 7. One of the example equalizing filters (c) may provide a 9 dB boost of an audio signal at predetermined center frequency such as 1 kHz, and the other example equalizing filter (d) a 6 dB cut of the audio signal at a predetermined center frequency such as 100 Hz. The example equalizing filter (d) may provide a 6 dB cut by having a relatively higher Q than the equalizing filter (c) and, thus, a sharper bandwidth.

Although the range of spectrum shaping functions is governed by the theory of linear filters, the adjustment of those functions and the flexibility with which they can be adjusted varies according to the topology of the circuitry and the requirements that are desired to be fulfilled. The shelving filters can be simple first-order filters which alter the relative gains between frequencies much higher and much lower than the corner frequencies of the filter. A low or bass shelf is adjusted to affect the gain of lower frequencies while having no effect well above its corner frequency. A high or treble shelf adjusts the gain of higher frequencies only. A single equalizer filter, on the other hand, can be implemented as a second-order filter function. This may involve three adjustments: selection of the center frequency, adjustment of the quality (Q) factor (which determines the sharpness of the bandwidth), and the level or gain which determines how much the selected center frequency is boosted or cut relative to frequencies (much) above or below the center frequency.

Figure 10:
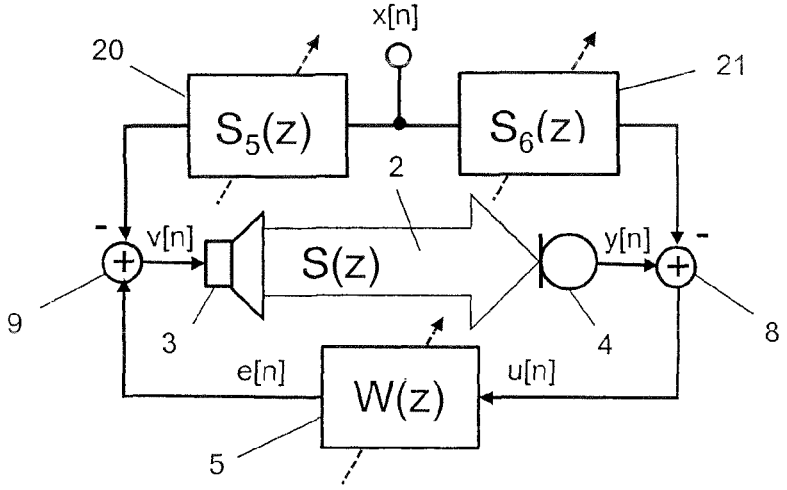
FIG. 10 is a block diagram of another example of an active noise reduction system, in which the useful signal may be supplied via spectrum shaping filters to the microphone and loudspeaker paths.

FIG. 10 is an example combination of the systems shown in FIGS. 4 and 5 in which the useful signal x[n] is supplied to both, the microphone and the loudspeaker path, each via a filter 20 having a transfer characteristic $S_5(z)$ or a filter 21 having a transfer characteristic $S_6(z)$, in which, for instance, $S(z)=S_5(z)\cdot S_6(z)$.

Although various examples of realizing the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. Such modifications to the inventive concept are intended to be covered by the appended claims.

I claim:

1. A noise reducing sound reproduction system comprising:

a loudspeaker that is connected to a loudspeaker input path;

a microphone that is acoustically coupled to the loudspeaker via a secondary path and connected to a first end of a microphone output path, the secondary path having a secondary path transfer characteristic;

a first subtractor that is connected to a second end of the microphone output path and a first end of a first useful-signal path;

an active noise reduction filter that is connected downstream of the first subtractor; and a second subtractor that is connected between the active noise reduction filter and the loudspeaker input path, the second subtractor further connected to a first end of a second useful-signal path; wherein a second end of the first useful-signal path and a second end of the second useful-signal path are connected with each other and configured to receive a useful signal to be reproduced by the loudspeaker, the useful signal being a signal before subtraction at the first or second subtractor, at least one of the first useful-signal path or the second useful-signal path comprises one or more spectrum shaping filters, at least one of the one or more spectrum shaping filters having a transfer characteristic that models the secondary path transfer characteristic, and a filter input signal is supplied to the active noise reduction filter by the first subtractor, the filter input signal approaching zero when noise reduction of the noise reduction filter is active.

2. The system of claim 1, wherein at least one of the one or more spectrum shaping filters has a transfer characteristic that linearizes a microphone signal on the microphone output path with regard to the useful signal.

3. The system of claim 2, in which the first useful-signal path comprises a first spectrum shaping filter that has a transfer characteristic that is substantially identical with the secondary path transfer characteristic.

4. The system of claim 3, in which the first spectrum shaping filter comprises at least two sub-filters.

5. The system of claim 4, in which the first spectrum shaping filter or at least one of the at least two sub-filters of the first spectrum shaping filter comprises an equalizing filter.

6. The system of claim 5, in which the equalizing filter comprises a treble cut equalizing filter.

7. The system of claim 4, in which the first spectrum shaping filter or one of the at least two sub-filters of the first spectrum shaping filter comprises a shelving filter.

8. The system of claim 7, in which the shelving filter comprises a treble cut shelving filter.

9. The system of claim 2, where the at least one of the one or more spectrum shaping filters comprises a first spectrum shaping filter, and the second useful-signal path comprises a second spectrum shaping filter that has a transfer characteristic that is substantially identical with an inverse of the secondary path transfer characteristic, and in which at least one of the active noise reduction filter, the first spectrum shaping filter, and the second spectrum shaping filter comprises an adaptive filter.

10. The system of claim 1, in which the first and the second useful-signal paths each comprise a respective spectrum shaping filter having respective transfer characteristics, and in which each of the first and the second useful-signal paths are configured to be supplied with the useful signal via their respective spectrum shaping filters.

11. A noise reducing sound reproduction method, comprising:

supplying an input signal to a loudspeaker by which the input signal is acoustically radiated;

receiving the signal radiated by the loudspeaker with a microphone, the microphone acoustically coupled to the loudspeaker via a secondary path, the microphone configured to provide a microphone output signal;

subtracting via a first subtractor the microphone output signal from a useful-signal to generate a filter input signal;

filtering the filter input signal with an active noise reduction filter to generate an error signal;

subtracting via a second subtractor the useful-signal from the error signal to generate the loudspeaker input signal; and filtering the useful-signal by one or more spectrum shaping filters prior to subtraction of the useful-signal from at least one of the microphone output signal or the error signal, where the first and second subtractors are each analog devices, and where the filter input signal approaches zero when noise reduction of the noise reduction filter is active.

12. The method of claim 11, in which the secondary path has a secondary path transfer characteristic, and in which the one or more spectrum shaping filters model in total the secondary path transfer characteristic.

13. The method of claim 12, in which the useful-signal, prior to subtraction from the microphone output signal, is filtered with a transfer characteristic that is substantially identical with the secondary path transfer characteristic.

14. The method of claim 13, in which the filtering the useful-signal includes at least one of equalizing or shelving filtering the useful-signal.

15. The method of claim 12, in which the useful-signal, prior to subtraction from the error signal, is filtered with a transfer characteristic that is substantially identical with an inverse of the secondary path transfer characteristic.

16. A noise reducing sound reproduction system comprising:

a first subtractor configured to receive an audio signal used to drive a loudspeaker to produce audible sound;

the first subtractor further configured to receive a microphone input signal, the microphone input signal comprising the audible sound received from the loudspeaker and an undesired noise detected by a microphone in a listening space;

the first subtractor further configured to subtract the audio signal from the microphone input signal and generate a filter input signal;

an active noise reduction filter in communication with the first subtractor, the active noise reduction filter configured to generate an error signal based on the filter input signal;

a second subtractor in communication with the active noise reduction filter, the second subtractor configured to subtract the audio signal from the error signal and output a loudspeaker input signal to drive the loudspeaker; and at least one spectrum shaping filter configured to receive and filter the audio signal, the at least one spectrum shaping filter configured to output the filtered audio signal to at least one of the first subtractor or the second subtractor, where the first and second subtractors are each analog devices, and where the filter input signal approaches zero when noise reduction of the noise reduction filter is active.

17. The noise reducing sound reproduction system of claim 16, where the at least one spectrum shaping filter comprises a first spectrum shaping filter and a second spectrum shaping filter, the first spectrum shaping filter configured to output the filtered audio signal to the first subtractor, and the second spectrum shaping filter configured to output the filtered audio signal to the second subtractor, where filtering by the first and second spectrum shaping filters are different.

18. The noise reducing sound reproduction system of claim 17, where the first spectrum shaping filter includes filter coefficients representative of an inverse of an estimated secondary path transfer characteristic between the loudspeaker and a listening position, and the second spectrum shaping filter includes the filter coefficients representative of the estimated secondary path transfer characteristic.

19. The noise reducing sound reproduction system of claim 16, where the at least one spectrum shaping filter comprises a first shelving filter configured as a boost filter operable at a first center frequency, and a second shelving filter configured as a cut filter operable with a second center frequency, the first center frequency being greater than the second center frequency.

20. The noise reducing sound reproduction system of claim 16, where the at least one spectrum shaping filter and the active noise reduction filter are each analog devices.

* * * * *